US009429028B2

(12) United States Patent
Buguin et al.

(10) Patent No.: US 9,429,028 B2
(45) Date of Patent: Aug. 30, 2016

(54) TURBINE ROTOR BLADE ROOT ATTACHMENTS

(71) Applicant: ALSTOM Technology Ltd, Baden (CH)

(72) Inventors: Arnaud Buguin, Gentilly (FR); Michel Floch, Drancy (FR); Julien Lemaire, La Garenne Colombes (FR)

(73) Assignee: ALSTOM Technology Ltd, Baden (CH)

( * ) Notice: Subject to any disclaimer, the term of this patent is extended or adjusted under 35 U.S.C. 154(b) by 659 days.

(21) Appl. No.: 13/950,337

(22) Filed: Jul. 25, 2013

(65) Prior Publication Data

US 2014/0064977 A1 Mar. 6, 2014

(30) Foreign Application Priority Data

Jul. 27, 2012 (EP) ..... 12178375

(51) Int. Cl.
*F01D 5/30* (2006.01)

(52) U.S. Cl.
CPC ..... *F01D 5/3053* (2013.01); *F05D 2220/31* (2013.01)

(58) Field of Classification Search
CPC ..... F01D 5/3053; F05D 2220/31
See application file for complete search history.

(56) References Cited

U.S. PATENT DOCUMENTS

| | | | | |
|---|---|---|---|---|
| 2,790,620 | A * | 4/1957 | Rankin | F01D 5/3053 416/217 |
| 4,321,012 | A * | 3/1982 | Tan | F01D 5/3053 416/217 |
| 5,062,769 | A | 11/1991 | Ortolano et al. | |
| 5,100,296 | A | 3/1992 | Partington et al. | |
| 6,004,102 | A | 12/1999 | Kuefner et al. | |
| 6,341,941 | B1 * | 1/2002 | Namura | F01D 5/16 416/190 |
| 6,494,683 | B1 * | 12/2002 | Nolan | B23K 9/0026 29/889.1 |
| 8,974,187 | B2 * | 3/2015 | Neumann | F01D 5/3023 416/217 |
| 9,028,218 | B2 * | 5/2015 | Asai | F01D 5/28 416/220 R |
| 2005/0047917 | A1 | 3/2005 | Brock et al. | |
| 2010/0232969 | A1 | 9/2010 | Behnke et al. | |
| 2011/0110786 | A1 * | 5/2011 | Neumann | F01D 5/3023 416/219 R |
| 2012/0308390 | A1 * | 12/2012 | Asai | F01D 5/28 416/204 R |

FOREIGN PATENT DOCUMENTS

| | | |
|---|---|---|
| CN | 101082287 A | 12/2007 |
| DE | 10 2008 031780 | 1/2010 |
| EP | 1 717 417 | 11/2006 |
| JP | 63-248901 | 10/1998 |

* cited by examiner

*Primary Examiner* — Richard Edgar
*Assistant Examiner* — Eldon Brockman

(57) ABSTRACT

A pinned root fixing arrangement of axial flow steam turbine rotor discs made of a low alloy that is less susceptible to stress corrosion cracking (SCC). Such an arrangement has a first ratio, which is defined as ratio of the axial breadth of the disc fingers and the sum of the axial breath and the axial breadth G of the gap between adjacent disc fingers, in the range of about 0.4 to about 0.6 and further has a second ratio, which is defined as the ratio of the length of the disc fingers and the blade fingers to the diameter, between 4 and 6.

2 Claims, 2 Drawing Sheets

TURBINE ROTOR BLADE ROOT ATTACHMENTS

CROSS-REFERENCE TO RELATED APPLICATIONS

This application claims priority to European Application 12178375.7 filed Jul. 27, 2012, the contents of which is hereby incorporated in its entirety.

TECHNICAL FIELD

This disclosure relates to turbine rotor blades for axial flow steam turbines, and in particular, to attachment of rotor blade roots to turbine rotor discs or drums using pinned root fixings that have improved resistance to stress corrosion cracking (SCC).

BACKGROUND

A well-known way of mounting turbine blades around the periphery of a turbine rotor, as described in German Patent application DE 10 2008 031 780 A1, comprises the so-called "pinned root fixing", in which radially and circumferentially extending flanges, called "disc fingers", on the periphery of the turbine rotor disc and corresponding "blade fingers" on the turbine blade root are inter-digitated with each other and fixed together by means of cylindrical metal rods, known as "pins", which pass axially through the blade fingers and the disc fingers. Such arrangements are particularly known for use on impulse blading in wet steam conditions. An example of such a blade is illustrated in FIGS. 1 and 2. FIG. 1 is a three-dimensional perspective view on the pressure side of a rotor blade unit 10 and FIG. 2 is a radial section through the periphery of a turbine rotor disc 20, showing how the disc is adapted for attachment of the turbine blade of FIG. 1.

Referring first to FIG. 1, when the blade unit 10 is oriented for operation in the turbine, its aerofoil 11 extends between a radially outer shroud 12 and a radially inner platform 13. Extending radially inwardly from the platform 13 is a blade root 14, which is divided into a number (in this particular case, four) of identical blade fingers 141, the fingers being of length L, axially spaced apart from each other, and mutually parallel. Each blade finger 141 has a radially outer portion 142 of breadth "b1" and a radially inner portion 143 of breath "b2", where b1>b2, and the transition between the inner and outer portions is marked by shoulders 144 Each outer portion 142 of the blade fingers has a through bore 145 of diameter "D1", and each inner blade finger portion 143 has a through bore 146 of diameter "D2". The bores 145 in the outer blade finger portions 142 are identically dimensioned and arranged axially in-line with each other. Similarly, the bores 146 in the inner blade finger portions 143 are identically dimensioned and arranged axially in-line with each other. In general, D1=D2.

Turning to FIG. 2, the periphery of the rotor disc 20 is divided into a number of radially and circumferentially extending, mutually parallel disc fingers 201, which are axially spaced apart from each other by radially and circumferentially extending identical grooves 202. The blade fingers are accommodated in the grooves 202 between the disc fingers; hence the number of disc fingers (in this particular case, five) is one more than the number of blade fingers. The grooves are of radial depth L2, which is the same as L1 except for a relief at the bottom of the grooves to prevent contact with the ends of the blade fingers 141. The grooves are dimensioned with appropriate tolerances to accept the fingers 141 of the blade root 14 as a sliding clearance fit. Hence, the radially inner finger portions 143 of the blade root 14 fit into radially inner portions 203 of grooves 202, of nominal breadth b2, and the radially outer finger portions 142 of the blade root 14 fit into radially outer portions 204 of grooves 202 having a nominal breadth b1. Consequently, the disc fingers 201 are shaped in a way that is complementary to the blade fingers 141, in that they have radially inner portions 205 of increased width relative to their radially outer portions 206, the transition between the inner and outer portions being marked by shoulders 207. Generally, the breadth b1 of the blade fingers is nominally the same as the breadth b1 of the disc fingers. Each inner disc finger portion 205 has a through bore 208 of diameter "D2", and each outer disc finger portion 206 has a through bore 209 of diameter "D1". Bores 208 and 209 match the bores 146 and 145 in the inner and outer blade finger portions 143 and 142, respectively. The radial dimensions of the disc fingers 201 and the blade fingers 141 are closely matched, so that when the blade fingers 141 are inserted into the grooves 202, shoulders 144 on the blade fingers 141 butt up against shoulders 207 on the disc fingers 201, bores 146 are axially in-line with bores 208, and bores 145 are axially in-line with bores 209. Appropriately dimensioned cylindrical pins (not shown) can therefore pass in a sliding clearance fit through the holes in the blade fingers 141 and the disc fingers 201 in order to attach the blades to the disc.

For economic and manufacturing reasons, the disc is made from a low alloy steel, comprising about 1 wt. % to about 3 wt. % nickel, whereas it is necessary to make the blades from a high alloy steel, comprising for example about 12 wt. % chromium, in order to ensure they have adequate resistance to water droplet erosion and high steam temperatures. It is well known that the area of the root sustaining the moving blades can be prone to SCC, which is caused by high peak stresses induced by contacts between root portions under high centrifugal loads when the steam turbine rotor is operating with steam close to saturation. The problem is further increased when the steam contains impurities that accelerate corrosion.

SUMMARY

In its broadest aspect, the present disclosure provides a pinned root fixing arrangement of an axial flow steam turbine rotor disc made of a low alloy and having a row of high alloy turbine rotor blades mounted thereon with reduced stress corrosion cracking (SCC) susceptibility, wherein the pinned root fixing comprises:

(a) radially and circumferentially extending disc fingers on the periphery of the turbine rotor disc, each disc finger having a length L and breadth b and adjacent disc fingers being separated by a gap of breadth G;

(b) blade fingers extending from the roots of the rotor blades and inter-digitated with the disc fingers; and c) at least one row of cylindrical pins of diameter D that pass axially through corresponding bores in the blade fingers and the disc fingers to fix the disc fingers and the blade fingers together;

The pinned rooting fixing arrangement has a first ratio, which is defined as ratio of the axial breadth (b) of the disc fingers and the sum of the axial breath and the axial breadth G of the gap between adjacent disc fingers, in the range of about 0.4 to about 0.6 and further has a second ratio, which is defined as the ratio of the length of the disc fingers and the blade fingers to the diameter, between 4 and 6.

The increase in diameter D of the pins that is required to reduce peak stress in the bores of the disc fingers to a value which reduces or eliminates SCC, should be evaluated on a case-by-case basis. However, our investigations to date have indicated that an increase in diameter D of a given percentage leads to a reduction in peak stress of a similar percentage. For example, an increase in D of 10% reduced peak stress by 10%.

The ratio b/M is used above in order to avoid alterations in the overall dimensions of the turbine disc, which would lead to unwanted design, development and manufacturing expense. Specifically, an increase in the ratio b/M means that the breadth of the disc fingers is increased by the same amount as the decrease in the gap between the disc fingers, thereby keeping the axial width of the turbine disc constant.

The breadth of the blade fingers is reduced because they must be a sliding fit in the gaps between the disc fingers. Consequently, in addition to reducing peak stresses in the disc fingers to a value less likely to promote SCC in the low alloy disc fingers, the above method increases peak stress in the bores of the high alloy blade fingers. However, because the high alloy blade fingers are more resistant to SCC than the low alloy disc fingers, it is possible to ensure that the peak stresses in the blade fingers are kept below values likely to promote SCC.

The value of b/M ranges narrowly between the above-mentioned upper and lower limits. The upper limit in the range of b/M is dictated by the increase in blade finger peak stresses consequent on the reducing thickness of the blade fingers as b/M increases, whereas the lower limit of b/M is dictated by the increase in disc finger peak stresses consequent on the reducing thickness of the disc fingers as b/M decreases. We have found that for values significantly higher than about 0.6, the blade finger stresses became too high, and for values significantly lower than about 0.4, the disc finger stresses became too high.

Normally, pinned root fixings have more than one row of pins. For example, two radially spaced-apart rows of pins are often used. Where there are two or more rows of pins and bores, we have found that to enable a sufficient increase in the diameter of at least the outer row of bores in the disc fingers without overstressing the disc fingers, it may be necessary to increase the length of the disc fingers, the length of the blade fingers also being increased by a corresponding amount. This is because increasing the diameter of a row of bores in the disc fingers without increasing the radial distance between radially adjacent rows of bores will increase the peak stress experienced by the low alloy disc material between the adjacent rows of bores. Increasing the length of the disc and blade fingers allows the radial distance between the adjacent rows of bores to be increased, which therefore reduces the peak stress in the disc finger (and blade finger) material extending between the adjacent rows of bores.

Hence, the above method may further include the step of increasing the ratio L/D by an amount sufficient to avoid overstressing the disc fingers. Note that there is an upper limit to the length L of the disc fingers, and hence an upper limit of L/D, which is determined by the maximum depth of the grooves between adjacent disc fingers that it is possible to manufacture accurately. We envisage that allowable values of L/D will range between an upper limit of 4 and a lower limit of 6.

It will not be necessary in all circumstances where there are two or more radially spaced rows of bores to increase the length of the disc fingers in order to allow larger diameter pins and bores to be used. Whether or not the disc fingers must be lengthened to allow increased radial spacing between adjacent rows of bores, and reduced stress in the disc material, must be assessed and calculated on a case-by-case basis.

In an example of the above method of SCC mitigation, in which a pinned root fixing for an existing SCC-prone turbine disc and blade combination was taken as a basis for comparison, and in which there were two radially spaced-apart rows of pins and bores, tests showed that SCC in the disc fingers was either eliminated, or at least reduced to acceptable levels, by a combination of the following measures:

- increasing the value of b/M from a standard value of 0.45 to an SCC mitigation value of 0.54;
- increasing the diameter D of the radially outer row of bores to obtain a reduction of 20% in the value of peak stress in the disc finger bores;
- the full increase in D being enabled by increasing the value of L/D from a standard value of 5 to an SCC mitigation value of 5.8.

Further aspects of the present disclosure will become apparent from a study of the following description and the appended claims.

BRIEF DESCRIPTION OF THE DRAWINGS

Embodiments of the concept disclosed herein will now be described, with reference to the accompanying drawings, which are not to scale, wherein.

DETAILED DESCRIPTION

Figure 1:
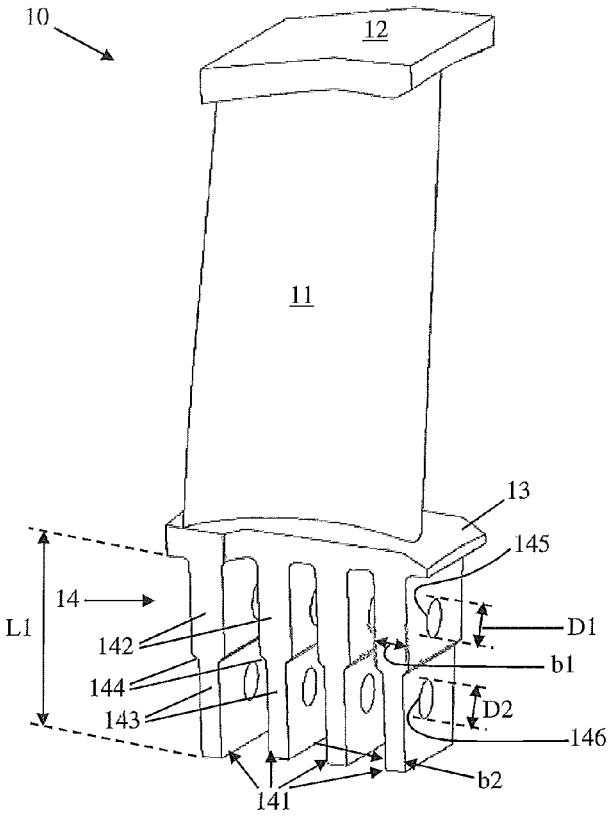
FIGURE 1 (PRIOR ART)
FIG. 1 is a three-dimensional perspective view on the pressure side of a known rotor blade unit ready for attachment to the periphery of an axial flow steam turbine rotor by means of a pinned root fixing.
Figure 2:
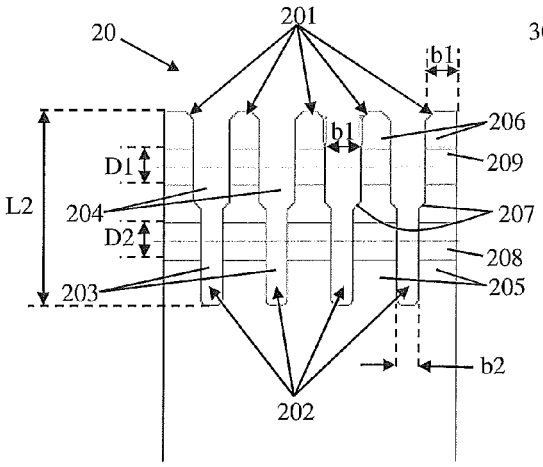
FIGURE 2 (PRIOR ART)
FIG. 2 is a radial section through the periphery of a known axial flow turbine rotor disc, showing how the disc is adapted for attachment of the turbine blade of FIG. 1.
Figure 3:
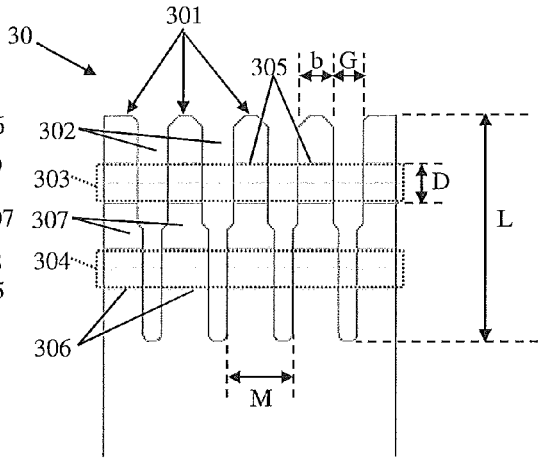
FIG. 3 illustrates how certain dimensions of the turbine rotor disc of FIG. 2 have been changed in order to modify the pinned root fixing in accordance with the concept disclosed herein.
Figure 4:
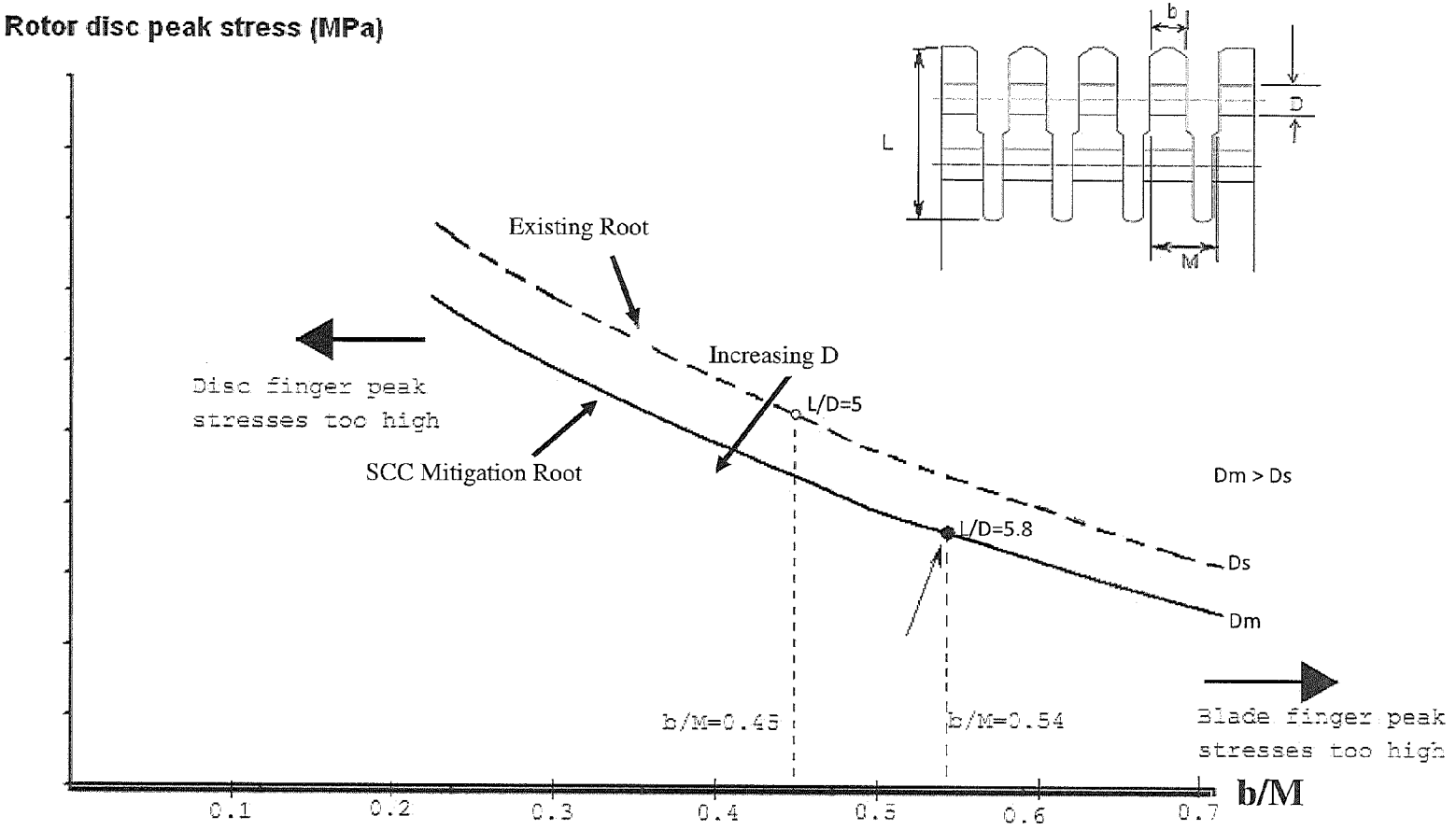
FIG. 4 is a graph illustrating how peak stress in the turbine rotor disc fingers varies with changing dimensional characteristics of the rotor disc shown in FIG. 3.

FIGS. 1 and 2 represent the prior art and have been described above under the heading Technical Background. In that design, the stress levels in the disc fingers and the blade fingers are equalised due to the approximately unity ratio of the disc finger thickness to the blade finger thickness along the line of the outer row of pins. During rotation the turbine rotor blades are subject to very large centrifugally induced loads, which are reacted through the blade fingers and the pins against the disc fingers. As previously mentioned, compared to the blade fingers 141, which are made of a high alloy steel, the rotor disc fingers 201 are more vulnerable to SCC, at least along the outer row of bores 209, because the rotor disc is made of a low alloy steel. The concept disclosed herein reduces the risk of SCC by changing some dimensions of the pinned root fixing, thereby reducing the peak stresses imposed on the disc fingers by the pins during rotation of the disc. FIGS. 3 and 4 illustrate the changes in dimensions due to implementation of the present concept, In FIG. 3, the radially outer portions of the radially and circumferentially extending disc fingers 301 on the periphery of the turbine rotor disc each have a length L and breadth b and adjacent disc fingers are separated by gaps or grooves 302 of breadth G. The sum of b+G is termed M, which can be thought of as a modulus of the axial spacing of the disc fingers. Although they are not shown in FIG. 3 for reasons of drawing clarity, the blade fingers extend from the inner platforms of the rotor blades and are inter-digitated (i.e., interleaved) with the disc fingers 301 so that the blade fingers and the disc fingers are radially co-extensive, except for a small clearance between the radially inner ends of the blade fingers and the radially inner ends of the grooves 302. As shown diagrammatically by dotted lines, there are two radially spaced apart rows of cylindrical pins 303, 304, passing axially through respective bores 305, 306 in the disc fingers 301, but only the outer row of pins 303 and bores 305 is subject to SCC mitigation in the illustrated embodiment.

In the SCC mitigation process, the peak stresses in the outer row of bores 303 in the disc fingers may be reduced by a combination of:

increasing the value of the ratio b/M by an amount in the range of about 0.4 to about 0.6, thereby increasing the breadth b of the disc fingers 301 by an amount δ and decreasing the breadth G of the gaps 302 between the disc fingers by the same amount δ, and as far as has been enabled by the increased breadth b of the disc fingers 301, increasing the diameter D of the pins 303 and the bores 305 by an amount sufficient to reduce the peak stresses in the bores below an SCC initiation level for the temperature and steam conditions being experienced during operation of the turbine.

Of course, the breadth of the blade fingers is also decreased by the amount δ so that they remain a sliding fit in the grooves 302. The necessary increase in breadth b and diameter D for the required stress reduction can be found by reiterative calculation using finite element analysis.

The ratio b/M is used to control modification of the breadth b of the disc fingers in order to keep the axial width of the turbine disc constant and so avoid alterations in the overall dimensions of the turbine disc.

Increasing the thickness b of the disc fingers 301 at the expense of the blade fingers facilitates the use of larger diameter pins and bores to reduce peak stress in the disc finger bores. The larger diameter pins and bores may also reduce peak stress in the blade finger bores, but the mean stress in the blade fingers increases because the reduced thickness of the blade fingers and the increased diameter of the holes reduces the amount of material in the blade fingers for the pins 303 to bear against and to resist bending and twisting forces imposed on the blade fingers during operation of the turbine. However, the high alloy of which the blade is made is more resistant to SCC than the low alloy of the disc, so a judicious increase in stress does not increase the risk of SCC in the blade fingers.

The SCC mitigation process is applied on a case-by-case basis. It may be that increasing the breadth of the disc fingers 301 does not allow the diameter of the outer row of bores 305 to be increased sufficiently to achieve the required decrease in their peak stress levels, without at the same time risking overstressing the disc finger material 307 between the radially outer and inner rows of bores 305, 306. Consequently, the SCC mitigation concept may also include increasing the length of the disc fingers 301 by increasing the ratio L/D by an amount sufficient to achieve a required decrease in stress between the inner and outer row of bores. The upper limit of L/D is determined by the maximum depth L of the grooves 302 between adjacent disc fingers that it is possible to manufacture accurately. At present, it is envisaged that allowable values of L/D will range between an upper limit of 4 and a lower limit of 6.

Taking an existing SCC-prone turbine disc and blade pinned root configuration as a standard, an example of an SCC mitigation process will now be explained. Referring to FIG. 4, the dashed curve shows schematically how disc finger peak stress in MPa may vary with the dimensionless value b/M for an existing pin diameter, Ds, in the radially outer row of pins, whereas the solid curve shows how disc finger peak stress may vary with b/M for an SCC mitigation pin diameter Dm, where Dm is greater than Ds.

In the existing pinned root configuration, with a pin diameter of Ds, b/M was measured as 0.45, and L/D was measured as 5. To reduce SCC in the disc fingers to insignificant levels, as measured on test rigs, it was found necessary to increase the value of b/M to an SCC mitigation value of 0.54, and increase the value of L/D to an SCC mitigation value of 5.8. These increased values of b/M and L/D allowed an increase in the diameter of the pins and bores to an SCC mitigation value of Dm, at which peak stress in the bores of the disc fingers was reduced by about 20%.

Adoption of the concept proposed herein confers much more resistance to SCC and therefore extends the operational lifetime of the turbine.

The above embodiments have been described above purely by way of example, and modifications can be made within the scope of the appended claims. Thus, the breadth and scope of the claims should not be limited to the above-described exemplary embodiments. Each feature disclosed in the specification, including the claims and drawings, may be replaced by alternative features serving the same, equivalent or similar purposes, unless expressly stated otherwise. Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. A pinned root fixing arrangement for an axial flow steam turbine rotor disc, said arrangement comprising:

cylindrical pins running axially through bores of an increased stress-reducing diameter in inter-digitated blade root fingers and disc fingers, wherein a first ratio (b/M), defined as an axial breadth (b) of disc fingers to a sum of the axial breadth (b) and an axial breadth (G) of a gap between adjacent disc fingers (M), is in a range of 0.4 to 0.6 and a second ratio (L/D), defined as a length (L) of the disc fingers and the blade root fingers to the diameter (D), is 5.8.

2. The arrangement of claim 1, wherein the first ratio is 0.54.

* * * * *